United States Patent [19]

Tanner

[11] Patent Number: 4,955,928

[45] Date of Patent: Sep. 11, 1990

[54] TENSIONING CONNECTOR FOR RETAINING SIGN MEMBRANES

[75] Inventor: James A. Tanner, Westerville, Ohio

[73] Assignee: Signstrut, Ltd., Dublin, Ohio

[21] Appl. No.: 339,685

[22] Filed: Apr. 18, 1989

[51] Int. Cl.[5] ..... G09F 17/00

[52] U.S. Cl. ..... 40/603; 160/354; 160/392

[58] Field of Search ..... 40/603, 156; 160/354, 160/378, 371, 392, 395; 24/580, 575, 579, 460, 462; 411/411, 414

[56] References Cited

U.S. PATENT DOCUMENTS

| | | | |
|---|---|---|---|
| 2,335,361 | 11/1943 | Schiller | 160/395 |
| 2,708,529 | 5/1955 | Lauder et al. | 24/580 X |
| 3,660,233 | 5/1972 | Dallce et al. | 411/411 X |
| 4,132,390 | 1/1979 | Pfarr, Jr. | 160/392 X |
| 4,317,302 | 3/1982 | Von De Linde | 40/603 X |
| 4,452,000 | 6/1984 | Gandy | 40/603 X |
| 4,539,734 | 9/1985 | Messerschmitt | 24/460 |
| 4,674,213 | 6/1987 | Keithley | 40/156 X |
| 4,674,214 | 6/1987 | Gandy | 40/603 |

FOREIGN PATENT DOCUMENTS

| | | | |
|---|---|---|---|
| 1251076 | 12/1960 | France | 24/580 |

OTHER PUBLICATIONS

Sign-Strut advertisement in Signs of the Times; Jul. 1988.

*Primary Examiner*—James R. Brittain

*Attorney, Agent, or Firm*—Colucci & Umans

[57] ABSTRACT

A tensioning connector, particularly suitable for tensioning the flexible membrane of a sign. The sign membrane is tensioned with a mechanical connector having two connecting components with generally interlocking surfaces. The interlocking surfaces have interengaging, mating, linear ridges. The cross section of the ridges has a generally sawtooth configuration. Both of the surfaces of each sawtooth ridge made an acute angle with the plane of the ridge tips. Importantly, both of these surfaces are on the same side of a normal to the plane.

19 Claims, 3 Drawing Sheets

FIG.3
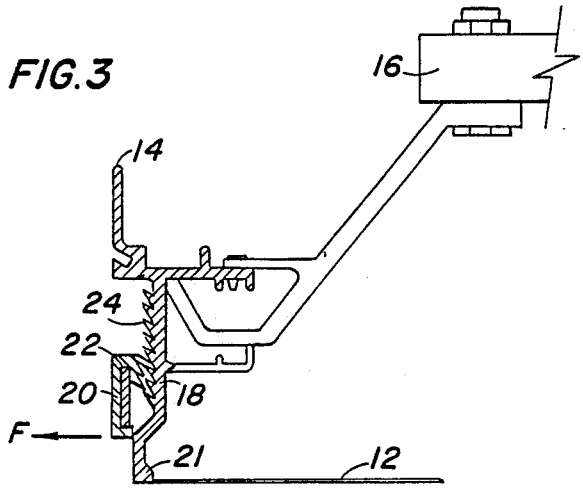
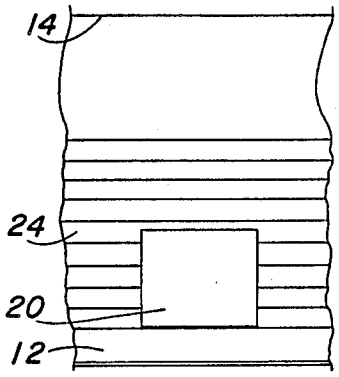
FIG.3A
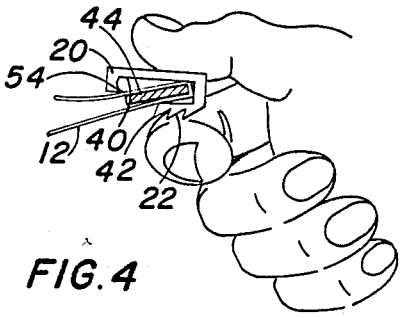
FIG.4
FIG.5
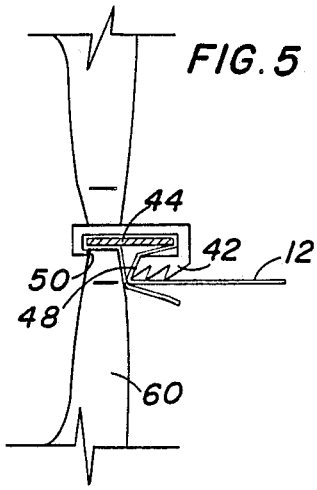
FIG.6
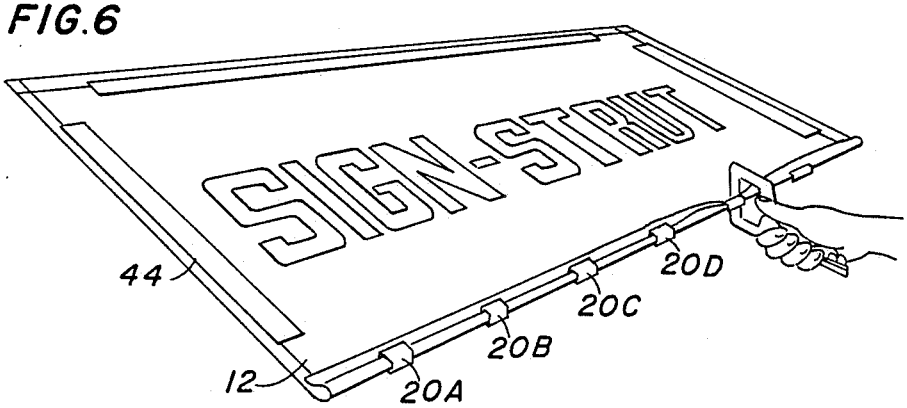

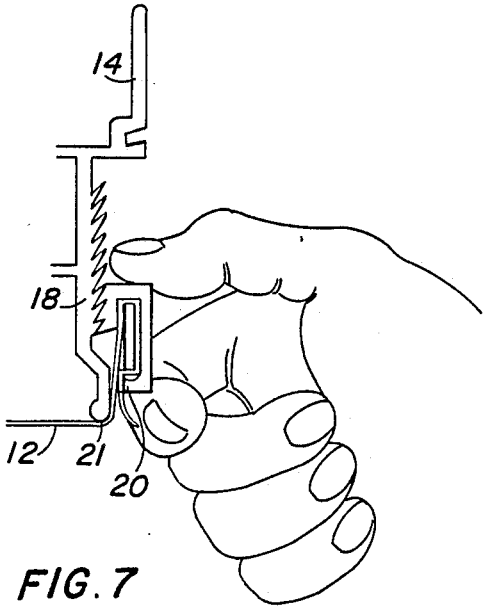
FIG. 7
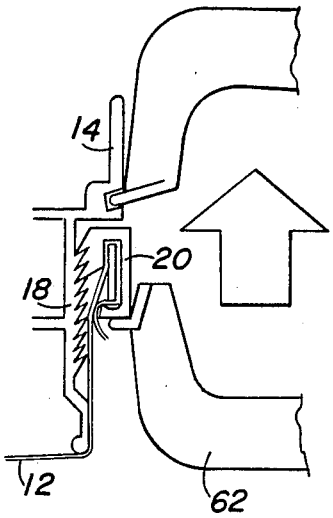
FIG. 8
FIG. 9
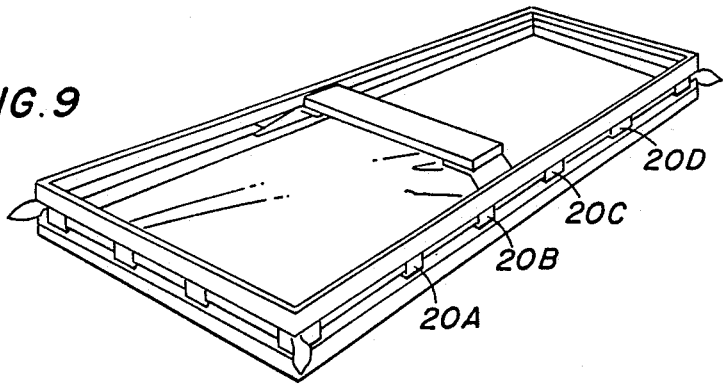
FIG. 10
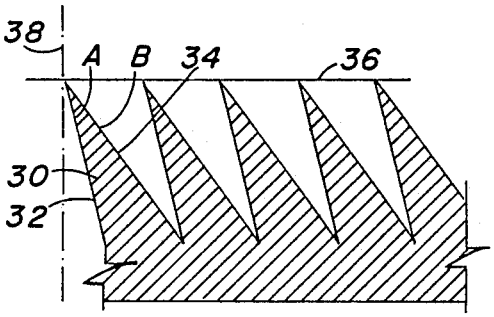

TENSIONING CONNECTOR FOR RETAINING SIGN MEMBRANES

TECHNICAL FIELD

This invention relates generally to an easily adjustable and releasable mechanical connector and more particularly relates to a connector which is particularly well suited for tensioning a web, such as a sign membrane.

BACKGROUND ART

One attractive and popular type of sign structure currently available today is a sign in which a sheet of flexible sign material is held in tension across the opening of a suitable frame. Signs of this type can be easily and economically changed and also permit the legends and graphics to be applied to the membrane at a different location and easily installed at the location of the sign. Signs of this type are also relatively inexpensive and quite durable. A variety of signs of this type have been shown in the prior art, such as in U.S. Pat. Nos. 3,885,335; 4,185,408; 4,265,039; 4,372,071; and 4,580,361.

A useful way of constructing signs of this type is to provide a plurality of tensioning devices which are spaced around the outer periphery of the support frame rearwardly of the frame opening which is defined by the edges of the frame sides. Typically, however, the prior art tensioning devices require the turning of a screw or other threaded fastener which is a relatively slow, time consuming, manual manipulation. Often these screws are not accessible except from the front of the sign and typically engage in holes at fixed position along the frame and therefore cannot be slid laterally to assist in the removal of wrinkles as the sign membrane is tensioned. Structures of this type are shown in U.S. Pat. Nos. 4,452,000; 4,554,754; and 4,674,214.

One difficulty with tensioning devices of this nature is that they typically require that the membrane be laid upon the frame and fitted to the tensioning devices. As a result, the membrane, when initially connected to the tensioning devices, is drooped across the opening of the frame. This results in excess, slack material positioned between the tensioning devices which must be taken up by the tensioning devices. Unless the slack is taken up perfectly uniformly, wrinkles occur. The result is that a substantial effort is required to remove the wrinkles and properly adjust the membrane. In addition, the conventional tensioning devices cannot be slid laterally to assist in the removal of those wrinkles.

One advantage of the present invention is that the sign membrane may be laid upon a flat, planar surface and the frame laid upon the membrane. The membrane is thus held in a relatively planar shape, similar to its position when tensioned, thus minimizing the excess, slack material which must be taken up later.

Another advantage of the present invention is that the tensioning device of the present invention is extremely easy to manipulate, both in tensioning the material and in sliding the tensioning devices laterally in order to help remove wrinkles.

Yet another advantage of the tensioning devices of the present invention is that they permit the membrane to be loosely attached and captured on the frame before significant tension is applied so that the material is held loosely in place before more precise tensioning is attempted.

Another advantage of the present invention is that its tensioning devices permit a broad range of adjustment and a substantial improvement in the ease and speed with which the sign membrane can be preliminarily attached to the sign frame and the ease and speed with which tensioning is accomplished. Tensioning is accomplished not by the twisting of a screw driver or other similar adjustment, but merely by a simple push from a human finger.

Still another feature and advantage of the present invention is that it is applicable to the tensioning of a broad variety of other membranes, such as the attachment of boat covers on boats, and has further advantages as a simple mechanical connector, such as for use as a picture or other object hanger.

BRIEF DISCLOSURE OF INVENTION

The invention utilizes a tensioning device which is a mechanical connector having two connecting components with generally interlocking surfaces for restraining one of the components against sliding translation in a selected direction relative to its other component and against rotation relative to its other component. The interlocking surfaces have interengaging, mating, ridges. The cross-section of these ridges have a generally sawtooth configuration. Both of the surfaces of each sawtooth ridge make an acute angle with the plane of the ridge tips. Importantly, the acute angles of both surfaces making up each sawtooth ridge are on the same side of a normal to the plane of the tips.

BRIEF DESCRIPTION OF DRAWINGS

FIG. 3 is a cross-sectional view, taken substantially along the line 3—3 of FIG. 1, illustrating more detail of the connecting member forming the preferred embodiment of the invention.

FIG. 3A is a side view of a segment of the frame illustrated in FIG. 3.

FIG. 4 and FIG. 5 are views in section illustrating the insertion of the strip and membrane within one component of s connector embodying the present invention.

FIG. 6 is a view in perspective illustrating a skip in the insertion of the strip within the connecting member.

FIG. 7 and FIG. 8 are views in section illustrating the tensioning adjustment of the membrane of a sign embodying the present invention.

FIG. 9 is a view in perspective illustrating a sign frame having a membrane tensioned thereon and embodying the present invention.

FIG. 10 is a diagrammatic detailed view of the ridges utilized in the present invention for defining the terms utilized in describing those ridges.

Figure 1:
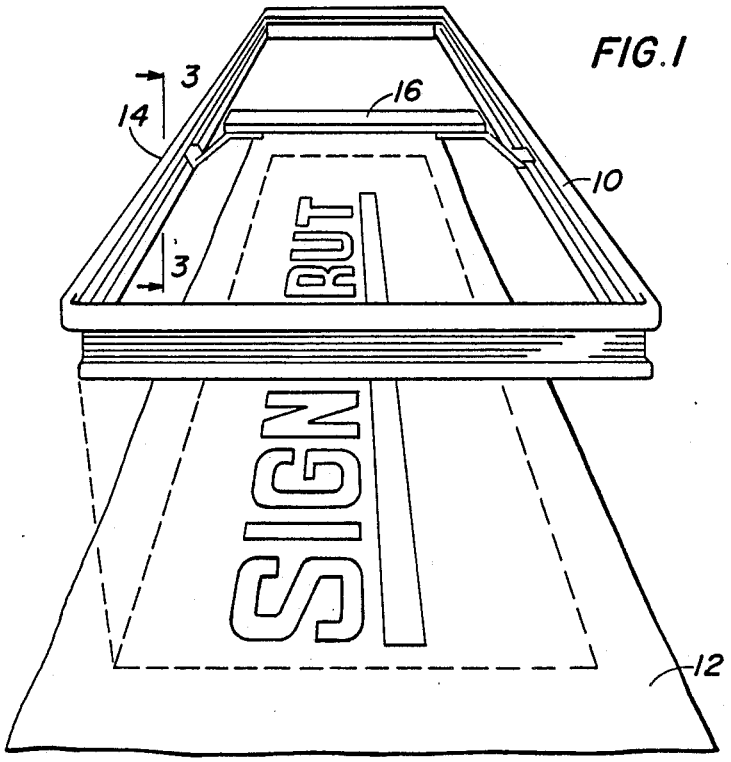
FIG. 1 is a view in perspective of a sign frame positioned above a membrane.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a sign frame lo positioned above a flexible sign membrane 12. The sign frame 10 is formed of four extruded sides, such as side 14, of identical/cross sectional configuration and strengthened by a cross brace 16. A portion of the frame 10 resting upon the membrane 12 is illustrated in more detail in FIG. 2.

FIGS. 3 and 3A illustrates the cross brace 16 connected to the extruded side 14. The side 14 includes a manually, releasable, mechanical connector having two connecting components. The first connecting component is integrally formed as a portion 18 of the side member 14. The other connecting component is a separately extruded, small connecting component 20. The connecting components are formed with generally interlocking surfaces 22 and 24 for restraining one of the components, for example the component 20, against certain motion with respect to the other component 18.

The interlocking surfaces are formed with interengaging, mating ridges having a generally sawtooth configuration. As a result of this configuration the components are restrained against sliding translation in a selected direction relative to the other component and against rotation relative to the other component. For example, in FIG. 3 the small component 20, even in the absence of the tensioned membrane 12, is restrained against relative movement in the downward direction with respect to the frame side 14 and also is restrained by the sawtooth configuration against rotation relative to the connector member 18 of the frame side 14.

The sawtooth configuration may not be just any of several conventionally known sawtooth configurations. Rather, in reference to FIG. 10, both of the surfaces of each sawtooth ridge must make an acute angle with the plane of the ridge tips on the same side of a normal to the plane. For example, in FIG. 10 the ridge 30 has two surfaces, 32 and 34, each of which is parallel to corresponding surfaces on the other sawtooth ridges. The surface 32 makes an acute angle A with the plane 36 of the ridge tips. The surface 34 also makes an acute angle B with the plane 36 of the ridge tips. Both of the surfaces 32 and 34 lie on the same side of a normal 38 to the plane 36.

Preferably, the ridges of the surface 24 on the frame 10 extend all around the frame 10 and are linear ridges so that the component 20 and a plurality of identical components spaced around the frame 10 may slide linearly along the ridges in both opposite directions parallel to the ridges. This allows each small component 20 to be slid along the frame to make adjustments in the membrane during the tensioning process when a plurality of such connecting members, such as 20A–20D, are spaced around the frame as illustrated in FIG. 9.

In addition, it is also desirable that one of the connector components, most preferably the connector components integrally formed on the frame sides, have substantially more ridges than the other connector component. This permits a substantially wider range of relative adjustment of the components. This allows, for example as illustrated in FIG. 7, the connector component to be slid from its lower position with less tension upon the membrane 12, upwardly toward the position illustrated in FIG. 8 to increase the tension on the membrane 20.

It has also been found extremely desirable to construct practical embodiments of the invention so that the tips of the ridges, when the connecting members are interengaged, are spaced from the bottom of the valleys of the opposed connector component. This is preferably accomplished by providing a slight rounding of the tips. It is believed that the reason this construction works so much better is that it makes allowance for manufacturing tolerances. It prevents the tips at some positions along the ridges from seating in the bottom of the valleys of the opposed component before others and thereby allows all surfaces of all ridges to interengage more snugly.

The result of interengaging connector members in accordance with the present invention is that even in the absence of the membrane 12 or other source of force parallel to the plane of the ridge tips, the connector components are maintained against relative movement with respect to each other, except for movements generally parallel to the surfaces of the ridges and movement in one direction perpendicular to the ridges to disengage them. Thus, for example and in reference to FIG. 3, even in the absence of the downward force on the connector 20 applied by the tensioned membrane 12, only a generally upward force exerted upon the connecting member 20 will release it from its engagement. It has been found, for example, that not only does the interengagement prevent the connecting component 20 from moving downwardly in FIG. 3, but additionally even with the application of only an outward force F perpendicular to the plane of the tips at the position illustrated, the components are retained in engagement and do not slide apart.

Therefore, as a result, this structure is useful for applications other than the tensioning of a membrane or other type of web. It is also useful for such things as simple picture hanging or other mechanical connection requiring restraint in those directions for which the present invention provides restraint against movement. As a further example, the present invention may be used for applying tension to a web which is formed as a band or strap. Such a band or strap may be fixed with respect to one connector component. For example, one component and a portion of the band may be connected to a common wall at spaced locations. The second connector component may be connected to another portion of the band and pulled into engagement with the first connector component.

It is clearly important that the web or sign membrane 12 apply its force, when placed under tension, so that the interengaging, inclined surfaces of the opposite ridges drive the connector components closer together and into engagement. This is accomplished by having the ridge surfaces which are at the greater acute angle facing generally in the direction of the tensioned portion of the web. Thus, for example, in reference to FIG. 10, the ridge surface 32 must face towards the tensioned web so that the force applied by the web will be to the left as illustrated in FIG. 10 to pull the engaging connector components together. The application of a force to the right, in the opposite direction, would, of course, cause the inclined plane surface 34 of the ridge 30 and all the parallel, interengaging surfaces to slide and separate the two connector components.

While the plane of the tips of the ridges can be aligned parallel to the direction of the tensioned web, it is preferable to orient the components so that the plane of the ridge tips is at an angle, most preferably 90 degrees, to the tensioned portion of the membrane 12, so that the membrane 12 is tensioned, as illustrated in FIG. 7, around an edge 21 of the sign frame.

Referring now to FIGS. 4 and 5, it is preferable that the component 20 be formed with a channel 40 which is generally parallel to its ridges 22 and opening in the same direction as the ridge's face, opening downwardly in FIGS. 4 and 5. The channel 40 has at least one inturned leg 42. The inturned leg is positioned at the side of the channel opposite the direction faced by those ridge surfaces which are at the greater acute angle to the plane of the ridge tips. This allows the membrane 12 or other web to be attached to that connector component 20 by means of a strip 44.

The strip 44 is positioned in the channel 40 with the membrane 12 extending around the strip 44, between the strip and the channel walls. In this manner the inturned leg 42 prevents the tension force applied by the membrane 12 from rotating the strip 44 and causing separation of the connector components and removal of the strip 44 and the surrounding membrane 12 from within the channel 40.

To accomplish this, the strip should have a width which is less than the su of the distance from the side of the channel having the inturned leg to the opposite outer edge of the channel, plus twice the thickness of the web. If the strip 44 were any wider, both it and two layers of membrane 12 could not simultaneously fit within the channel 40. Additionally, the strip 44 must have a width greater than the distance from the innermost edge 48 of the inturned leg 42, see FIG. 5, to the opposite side 50 of the channel so that the strip 44 and membrane 12 will be retained within the channel 40 by the inturned leg 42.

The operation of this structure for connecting the membrane 12 within the channel 40 is further enhanced by providing a slight second leg 54, see FIG. 4, on the side of the channel 40 which is opposite the first inturned leg 42. This further retains the strip 44 and the surrounding membrane 12 within the channel.

Figure 2:
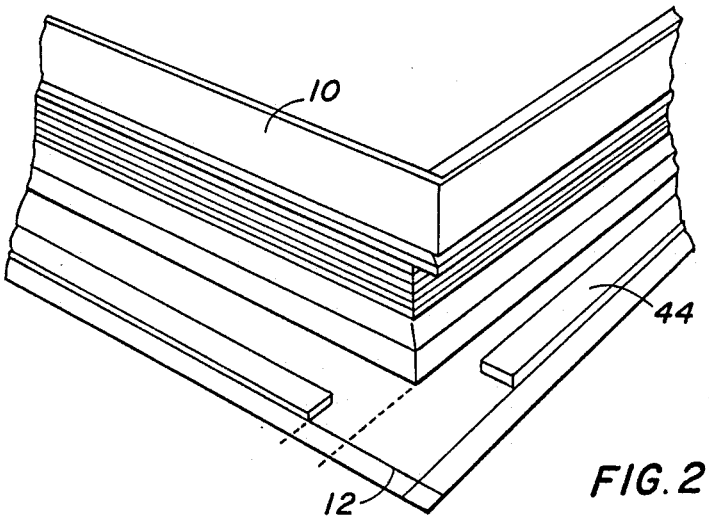
FIG. 2 a view in perspective showing more detail of the frame when resting upon the membrane.

To assemble a sign embodying the present invention, the frame 10 is positioned over the membrane 12, as illustrated in FIG. 1, and then lowered onto it into the position illustrated in FIG. 2.

A plurality of relatively small, short connector components such as 20A–20D are then attached to the membrane 12 at spaced positions around the frame 10. This is accomplished by positioning the strips, such as strip 44, upon the backside of the membrane 12, as illustrated in FIG. 2, and then overlying the flexible membrane over the strips and inserting the strips, such as strip 44, within the channel 40, as illustrated in FIG. 4. The strip 44 may then be compressed by the jaws 60 of a suitable compressing tool, as illustrated in FIG. 5, to force the strip 44 and its surrounding membrane 12 into the channel 40. This task is illustrated in FIG. 6. If the strips are made sufficiently narrow, but within the limits described above, the strips and membrane may be inserted by hand.

After all of the relatively smaller connector components, such as connector components 20A–20D illustrated in FIG. 6, are connected to the membrane 12 by means of the strips, such as strip 44, the outer edges of the membrane 12 are lifted upwardly to the position illustrated in FIG. 7 to interengage the ridges. The small connector members, such as connector member 20, are then slid to provide slight tension upon the membrane 12 so that all connectors are held in their engaged positions.

The smaller connector components, such as connector component 20, may then be slid sideways along the ridges to minimize the wrinkles and simultaneously may be simply slid by a manual push of the fingers to a tighter position toward the position illustrated in FIG. 8. This allows a very simple manual manipulation as the entire periphery of the membrane is adjusted and tightened.

If, during the initial tensioning process, it is discovered that one side of the frame should be released a small amount and the opposite side tightened a small amount, this is easily accomplished by lifting the small connector components, such as component 20, away from the front face of the frame and replacing it at the desired position.

After the membrane is uniformly tightened so that there are no wrinkles, a further compressing tool, such as the compressing tool 62 illustrated in FIG. 8, may be applied to increase the tension by sliding the components, such as component 20, further with respect to the component 18.

As best shown in FIG. 8, compressing tool 62 has one jaw which fits into a slot formed by a rail in the component 14, spaced from the ridges in that component on an opposite side from the tensioning edge 21. Compressing tool 62 can be used for engaging the component 20 and forcing the component 20 toward the rail (in the upward direction of FIG. 8) to increase the tension on the web.

While certain preferred embodiments of the present invention have been disclosed in detail, it is to be understood that various modifications may be adopted without departing from the spirit of the invention or scope of the following claims.

I claim:

1. An improved, manually releasable mechanical connector having two connecting components with generally interlocking surfaces for restraining one of its components against sliding translation in a selected direction relative to its other component and against rotation relative to its other component to tension a web, wherein the improvement comprises:

said interlocking surfaces having interengaging, mating, ridges with tips thereon and valleys therebetween, the cross section of the ridges having a generally sawtooth configuration with both of the surfaces of each sawtooth ridge making an acute angle with a plane of the ridge tips on the same side of a normal to said plane of the ridge tips, means for detachably connecting one of said components to a web, the other of said components including means for supporting the web in a web plane, the web plane extending at a non-zero angle to the plane of the ridge tips, said means for supporting the web including a tensioning edge on said other of said components which is spaced away from the ridges of said other of said components, around which the web is engageable with interlocking interengagement of the two connecting components, said one of said components which is detachably connected to the web having said interengaging ridges on one side only, an opposite side of said one of said components being free of ridges and being freely accessible and out of contact with said other of said component for movement of said one of said components along said other of said components.

2. A connector in accordance with claim 1 wherein said ridges are linear to permit relative, sliding translation of one component with respect to the other in directions parallel to ridges.

3. A connector in accordance with claim 1 or 2 wherein, in operable engagement of the components, the tips of the ridges of each component are spaced from the bottom of the valleys of the other component.

4. A connector in accordance with claim 3 wherein one of said components has substantially more ridges than the other to permit relative sliding adjustment of the other component in one direction perpendicular to the ridges.

5. A connector in accordance with claim 1 or 2 wherein one of said components has substantially more ridges than the other to permit relative sliding adjustment of the other component in one direction perpendicular to the ridges.

6. A connector according to claim 1 wherein said other of said components includes a rail extending parallel to the ridges of said other of said components, at a location spaced from the ridges of said other of said components on a side of the ridges opposite from the tensioning edge for receiving the jaw of a compressing tool for engagement with the one of said components for pressing the one of said components toward the rail for tightening the interengagement between the ridges of the two components while tensioning the web.

7. An improved, manually releasable mechanical connector assembly, having two connecting components with generally interlocking surfaces for restraining one of the components against sliding translation in a selected direction relative to the other of said components, and against rotation relative to the other of said components to tension a web, the improvement comprising:

said interlocking surfaces having interengaging, mating, ridges with tips thereon and valleys therebetween, the cross section of the ridges having a generally sawtooth configuration with both surfaces of each ridge for each component making an acute angle with the plane of the ridge tips on the same side of a normal of the plane of the ridge tips, one of said components being formed with a channel generally parallel to the ridges and opening in the same direction as both its ridge surfaces, the channel having at least one inturned leg at its side opposite the direction faced by those ridge surfaces which are at the greater acute angle, a web attached to said one component and a strip having a width which is less than the sum of the distance from the side of the channel having the inturned leg to an outer edge of the channel opening at an opposite side of the channel, plus twice the thickness of the web, the strip having a width greater than the distance from an innermost edge of the inturned leg to the opposite side of the channel, the strip positioned in the channel with the web extending around the strip between the strip and the channel, said one of said components which is detachably connected to the web having said interengaging ridges on one side only, an opposite side of said one of said components being free of ridges and being freely accessible and out of contact with said other of said component for movement of said one of said components along said other of said components.

8. A connector in accordance with claim 7 wherein a second leg extends from the side of the channel opposite the inturned leg.

9. A connector in accordance with claim 7 wherein, in operable engagement of the components, the tips of the ridges of each component are spaced from the bottom of the valleys of the other component.

10. A connector in accordance with claim 9 wherein one of said components has substantially more ridges than the other to permit relative sliding adjustment of the other component in one direction perpendicular to the ridges.

11. An apparatus for tensioning a web of flexible material, the apparatus comprising:

a manually releasable mechanical connector having two connecting components with generally interlocking surfaces for restraining one of its components against sliding translation in a selected direction relative to its other component and against rotation relative to its other components, said interlocking surface being on one side only of each of said components and having mating, interengaging ridges, the cross section of the ridges having a generally sawtooth configuration with both of the surfaces for each sawtooth ridge making an acute angle with the plane of the ridges on the same side of a normal to said plane, a first portion of the web being detachably attached to one of said components and the other component being fixed with respect to another portion of the web for tensioning the web in a web plane between said other portion of the web and said one component, the ridge surfaces which are on said one component attached to the web and which are at the greater acute angle facing toward the tensioning portion of the web, said web plane extending at a non-zero angle to the plane of the ridges, the other component having a tensioning edge spaced from the ridges of the other component around which the web is tensioned with interengagement of the ridges of the two components, a side of said one component opposite from said interengaging ridges being free of ridges and said one component being freely accessible for movement with respect to said other component and out of contact with said other component.

12. A connector in accordance with claim 11 wherein said ridges are linear to permit relative sliding translation of one component with respect to the other parallel to ridges.

13. A connector in accordance with claim 12 wherein, in operable engagement of the components, tips of the ridges of each component are spaced form the bottom of valleys between the ridges of the other component.

14. A tensioning apparatus in accordance with claim 13 comprising a pair of said connectors one component of each connector attached to the web at spaced portions of the web, the other component of each connector being fixed to a common support frame, the ridge surfaces which are on the components attached to the web and which are at the greater acute angle facing toward the tensioned portion of the web.

15. A tensioning apparatus in accordance with claim 14 wherein the web is a sheet of flexible material, wherein the connector components which are attached to the support frame are elongated and substantially longer than the components attached to the flexible sheet and wherein there are a plurality of additional connector components attached to the sheet and engaged to the elongated components.

16. A flexible sheet tensioning apparatus in accordance with claim 15 wherein said elongated components are oriented at an angle to the flexible sheet which extends between the engaged connectors.

17. A flexible, sheet tensioning apparatus in accordance with claim 16 wherein the elongated components are substantially at a right angle to the flexible sheet.

18. A tensioning apparatus in accordance with claim 15 wherein the connector components which are attached to the flexible sheet are formed with a channel generally parallel to the ridges and opening in the same direction as both its ridge surfaces, the channel having at least one inturned leg at its side opposite the direction faced by those ridge surfaces which are at the greater acute angle and wherein the web is attached to that component by means of a strip having a width which is less than the sum of the distance from the side of the channel having the inturned leg to an opposite outer edge of the channel plus twice the thickness of the web, the strip having a width greater than the distance from an innermost edge of the inturned leg to the opposite side of the channel, the strip positioned in the channel with the web extending around the strip between the strip and the channel walls.

19. A connector in accordance with claim 18 wherein a second leg extends from the side of the channel opposite the first leg.

* * * * *